United States Patent [19]

Didek et al.

[11] 4,281,507

[45] Aug. 4, 1981

[54] FRICTIONAL OPEN-END SPINNING METHOD AND APPARATUS

[75] Inventors: Stanislav Dídek; Ludvík Fajt; Jaroslav Štorek; Jiří Andres; František Čada; Marie Marková, all of Ústí nad Orlicí, Czechoslovakia

[73] Assignee: Vyzkumny ustav bavlnarsky, Ústí nad Orlicí, Czechoslovakia

[21] Appl. No.: 40,132

[22] Filed: May 17, 1979

[30] Foreign Application Priority Data

May 17, 1978 [CS] Czechoslovakia ..... 3174-78

[51] Int. Cl.[3] ..... D01H 1/12; D01H 7/882

[52] U.S. Cl. ..... 57/58.89; 57/58.95

[58] Field of Search ..... 57/58.89–58.95

[56] References Cited

U.S. PATENT DOCUMENTS 4,168,601 9/1979 Didek et al. ..... 57/58.95

*Primary Examiner*—John Petrakes

[57] ABSTRACT

A method of and apparatus for frictional open-end spinning which is an improvement upon that disclosed by the co-assigned U.S. Pat. No. 4,168,601. Continuously supplied separated fibers are deposited onto a first, frictional carrying surface provided on a revolving carrier and designed for conveying the fibers to the mouth of a wedge-like gap defined by said frictional carrying surface and a second frictional surface provided on a second revolving carrier moving in said wedge-like gap in the opposite direction relative to the first, frictional carrying surface. The fibers are twisted to yarn in the mouth of the wedge-like gap due to the contact with said frictional surfaces of which one is convex and the other concave. The yarn is withdrawn from said gap in a lateral direction and the twist propagation is prevented. The fibers supplied by the frictional carrying surface into the wedge-like gap are transferred, at least in a yarn preforming region followed by a yarn finishing region, immediately downstream of the mouth of the wedge-like gap, by the action of a first force onto said second frictional surface, from which the fibers after having left the wedge-like gap, are transferred by the action of a second force again onto said frictional carrying surface upstream of the mouth of said wedge-like gap.

32 Claims, 17 Drawing Figures

FRICTIONAL OPEN-END SPINNING METHOD AND APPARATUS

This application is related to the co-assigned application of Didek et al, Ser. No. 882,116, filed Feb. 28, 1978, now Pat. No. 4,168,601.

The invention relates to an improvement of the method of and the apparatus for frictional spinning based upon the open-end principle disclosed in the co-assigned German published application /DE-OS/ No. 2,809,599.

The aformentioned application relates to a method comprising depositing continuously supplied separated fibers onto a first, frictional surface provided on a first, revolving carrier and designed for conveying the fibers to the mouth of a wedge-like gap defined by said first, frictional surface and a second, frictional surface provided on a second, revolving carrier moving in said wedge-like gap in the opposite direction relative to the first, frictional surface, one of the frictional surfaces being convex and the other being concave, twisting the fibers to yarn in the mouth of said wedge-like gap, and withdrawing the yarn along the length of the wedge-like gap while preventing twist propagation.

The inventive feature of the apparatus provided for carrying out the above described method consists in that one of the frictional surfaces for the yarn building placed in the mouth of the wedge-like gap, is convex and the other is concave.

In the present specification, the frictional surface supplying the fibers to the wedge-like gap will hereinafter be called the "first, frictional carrying surface", and the other with the latter cooperating surface will be called the "second frictional surface".

A method of frictional spinning based upon the open-end spinning principle has also been disclosed in the German application /DE-OS/ No. 2,618,865. According to this method, separated fibers are supplied to a wedge-like gap provided between the inner wall of an outer drum and the outer wall of an inner drum, the fibers being accumulated in said gap and, due to the relatively opposite rotation of said drums, twisted to yarn which is withdrawn from said gap. The axes of the two drums are parallel to each other. The fibers are supplied to the wedge-like gap either on the inner wall of the outer drum or on the outer wall of the inner drum by the action of pneumatic, electrostatic, or centrifugal forces. In the case of the first-mentioned alternative, the fiber conveyor is embodied as a screen drum.

It is an object of the present invention to improve such frictional open-end spinning method so as to provide conditions for an optimum course of the spinning process and thus to improve the quality of the yarn being produced.

According to one aspect of the present invention there is provided a method of frictional spinning based upon the open-end principle, such method comprising depositing continuously supplied separated fibers onto a frictional carrying surface provided on a revolving carrier and designed for conveying the fibers to the mouth of a wedge-like gap defined by said frictional carrying surface and a second frictional surface provided on a second revolving carrier moving in said wedge-like gap in the opposite direction relative to the frictional carrying surface, twisting the fibers to yarn in the mouth of the wedge-like gap due to the contact with said frictional surfaces of which one is convex and the other concave, and withdrawing the yarn from said gap in a lateral direction while preventing twist propagation. In the method according to the present invention the fibers supplied by the frictional carrying surface into the wedge-like gap are transferred, at least in a yarn preforming region which is followed by a yarn finishing region, immediately downstream of the mouth of the wedge-like gap, by the action of a first force onto said second frictional surface from which the fibers after having left the wedge-like gap are transferred by the action of a second force again onto said frictional carrying surface upstream of the mouth of said wedge-like gap.

The first force is exerted by a suction field on the second frictional surface downstream of the mouth of the wedge-like gap while the second force arises, for example, by a centrifugal force to which the fibers are exposed on the concave frictional surface.

Preferably, the second force coacts with a third force excited by an auxiliary suction field on the convex frictional surface upstream of the mouth of the wedge-like gap.

In accordance with another preferred embodiment, the second force is exerted by the suction field on the concave frictional surface upstream of the mouth of the wedge-like gap, the first force being exerted downstream of the wedge-like gap, on the one hand, by the sucking field on the second frictional surface and, on the other hand, by a coacting centrifugal force to which the fibers are exposed on the concave frictional surface.

To achieve an effective rolling of the yarn on the frictional surfaces in the yarn finishing region, which rolling substantially raises the twist imparting effectiveness, the yarn being twisted in the wedge-like gap in the yarn finishing region is driven into the wedge-like gap by the action of a fourth force.

The fourth force can be exerted by an air stream forcing the yarn being produced into the wedge-like gap, by a subatmospheric pressure produced in the wedge-like gap, or by both of them simultaneously. The subatmospheric pressure can be produced in the wedge-like gap by two additional suction fields situated on the two frictional surfaces in the wedge-like gap.

According to another aspect of the present invention there is provided an apparatus for carrying out the above method, comprising a mechanism for supplying the separated fibers onto a frictional carrying surface of a pair of frictional surfaces provided on respective inner and outer revolving carriers and associated in contactless manner with each other so as to form a wedge-like gap in which the fibers are twisted due to friction with the two frictional surfaces moving in relatively opposite directions in said wedge-like gap, one of the frictional surfaces being concave and the other being convex relative to the yarn forming region in said wedge-like gap, and a mechanism for taking off the yarn from said wedge-like gap, said yarn take-off mechanism being adapted to prevent any twist propagation.

According to the invention, the apparatus is characterized in that on the second frictional surface, which is perforated at least in the yarn preforming region, a suction field is provided downstream of the mouth of the wedge-like gap in the yarn preforming region, said field being sharply defined in said mouth of the wedge-like gap for transferring the fibers from the frictional carrying surface onto the second frictional surface.

In one embodiment, the second frictional surface is the frictional surface of the inner carrier on which the suction field is situated downstream of the mouth of the wedge-like gap.

In another embodiment, the second frictional surface is the frictional surface of the outer carrier on which the suction field is situated downstream of the mouth of the wedge-like gap.

Alternatively, the second frictional surface is the frictional surface of the outer carrier on which the suction field is situated downstream, the mouth of the wedge-like gap, there being provided on the frictional surface of the inner carrier which surface is perforated at least in the yarn preforming region, an auxiliary suction field situated upstream the mouth of the wedge-like gap.

Still another embodiment is the second frictional surface, the frictional surface of the inner carrier on which the suction field is situated downstream, the mouth of the wedge-like gap, there being provided on the frictional surface of the outer carrier, which surface is perforated at least in the yarn preforming region, an auxiliary suction field situated upstream, the mouth of the wedge-like gap.

To achieve an effective rolling of the yarn on the frictional surfaces in the yarn finishing region, which rolling substantially enhances the twist imparting effectiveness, there is provided an embodiment wherein upstream of the mouth of the wedge-like gap, at least in a part of the yarn finishing region, a blowing nozzle is provided for forcing the yarn into the wedge-like gap.

Further there exist various other embodiments in which a blowing nozzle is provided. Thus, for instance, a preferred embodiment is characterized in that downstream of the mouth of the wedge-like gap, in the yarn finishing region, an additional suction field is provided on the second frictional surface for producing a subatmospheric pressure in the wedge-like gap. Alternatively, the two frictional surfaces are unperforated in the yarn finishing region.

According to another preferred embodiment, on the two frictional surfaces perforated in the yarn finishing region, an additional suction field is provided downstream of the mouth of the wedge-like gap for producing a subatmospheric pressure in the wedge-like gap.

Due to an expedient action of the aforementioned forces, the fibers supplied into the wedge-like gap follow a circular path in the yarn preforming region, while the direction of their movement corresponds to the direction of torque to which the yarn is subjected in the yarn finishing region. The torque is produced by deflecting the yarn out of an imaginary line connecting the yarn forming point, i.e. center of the aforementioned circular path, with the center of the yarn being finished in marginal portions of the two frictional surfaces facing the yarn take-off rollers. Due to an aformentioned intense and controlled force action, the yarn is forced onto said marginal portions of the frictional surfaces in order to exert a sufficient frictional force on the yarn component. Apart from the yarn end rotation arising by rolling between the frictional surfaces in the wedge-like gap, the yarn is given a very intense twist so that the spinning system delivers, with relatively high productivity, sufficiently twisted yarn at relatively very low peripheral speeds of the frictional surfaces; this constitutes a substantial improvement from the viewpoint of the lifetime, noise level, and power demand of the system.

Surprisingly, it has been found out that the yarn twisted due to an interaction between the preforming and finishing regions closely approaches the character of orthodox ring spun yarn types. The highly oriented yarn structure can be attributed to considerably parallelized fibers. The yarn can be very easily untwisted.

The strength, appearance and evenness of this yarn allow it to be easily and advantageously processed to textile fabrics such as, preferably, fabrics designed for raising, plush carpets, corduroys or the like. Due to an expedient yarn end rotation control by the force action on the two frictional surfaces in the region of the wedge-like gap, it is possible to produce even extra fine yarns without the occurrence of any passage of the yarn from the apex of the wedge-like gap into the inactive wedge-like gap.

The rolling of yarn on the frictional surfaces without substantial slippage in the wedge-like gap cannot be expected unless the fibrous formation constitutes a substantially cylindrical body having a certain density and consequently a certain diameter. This latter, however, cannot be determined until there is a sufficiently twisted fibrous formation which, however, cannot be produced in any other way than by means of an initial controlled revolution of the fibers, supplied to the space between the frictional spaces, around the circular path.

Preferably, the peripheral speed of the frictional carrying surface should be higher than that of the second frictional surface.

One of the factors positively influencing the frictional spinning process is a perforation provided on the frictional surface of one or both of the carriers.

Since a suction force acting locally on the frictional surface is active in the perforated areas only, but is inoperative on the inter-hole portions, attempts have been made to disproportionally increase the number of holes on the perforated surface areas. This, however, has raised manufacturing costs as well as the power demand for producing technological superatmospheric pressure air, the consumption of which may even influence the effectiveness of the spinning process.

Also, it is an object of the invention to achieve a maximum suction effect on the frictional surface of the carriers with a given power demand available for the production of subatmoshperic pressure air.

According to one aspect of the invention, the perforations of at least one of the frictional surfaces are formed by holes the cross-sectional area of which increases, beginning from a nominal profile area thereof in the direction toward the inlet of the holes.

In a preferred embodiment, the nominal cross-sectional or profile area in the middle portion of the height of the holes is smaller than the profile area at the inlet of the holes.

The wall of the holes can be preferably constituted by a surface of rotation, the generatrix thereof being a straight line, a curve, such an arc curve, or a combination of various sections of which some comprise linear and other curvilinear portions.

In a preferred embodiment, the spacings between the holes are either identical in both the longitudinal and peripheral directions, or staggered in the longitudinal and/or peripheral directions by, preferably, 0.5 spacing.

In the first case, the smallest distance between the holes should preferably be equal to the maximum dimension, and in the second case, at the most to the treble dimension of the nominal profile area.

Alternatively, the hole walls can be also formed as a suitable surface of non-rotation, such as, for example, of square profile.

With known frictional open-end spinning systems, the axial tension in the yarn in the space comprising the yarn preforming region, the yarn finishing region, and the distance between the outlet from the wedge-like gap and the yarn take-off mechanism is relatively small. Consequently, the twist is insufficiently fixed in the yarn so that the latter tends spontaneously to untwist. To avoid this disadvantage, such known systems operate with a higher twist rate, the disadvantage of which is in turn, on the one hand, a lower machine production and, on the other hand, an over-twist loop formation upstream of the take-off mechanism, and unevenness of both twist and yarn structure. These shortcoming manifest themselves especially with fibrous material exhibiting an increased resistance to twisting.

It is therefore an object of the invention to establish conditions for achieving an effective axial tension in the yarn being spun.

One of the factors pointing to this object is the character of the frictional surfaces of the carriers.

This is why one of the further features defining the subject matter of the present invention consists in that at least on the frictional carrying surface of the two frictional surfaces, at least in the yarn finishing region thereof, roughening means are provided for increasing the coefficient of friction of the frictional surface. It is preferable to provide the roughening means on the frictional carrying surface.

From the viewpoint of friction conditions in the production of yarn, the density of the roughening means should preferably increase in the direction of yarn withdrawal from the wedge-like gap.

The roughening means can be variously embodied as, for instance, annular grooves the density of which can increase in the direction of yarn withdrawal from the wedge-like gap, helical grooves the pitch of which can decrease in the direction of yarn withdrawal from the wedge-like gap, or of which the pitch direction is opposite to the yarn twist direction.

Some of the preferred embodiments of the present invention will be hereinafter described by way of example, with reference to the accompanying schematic drawings, in which.

FIGS. 8 to 11, inclusive, are partial cross-sectional views of various embodiments of perforation holes in the frictional surface of the carrier.

Figures 1, 13:
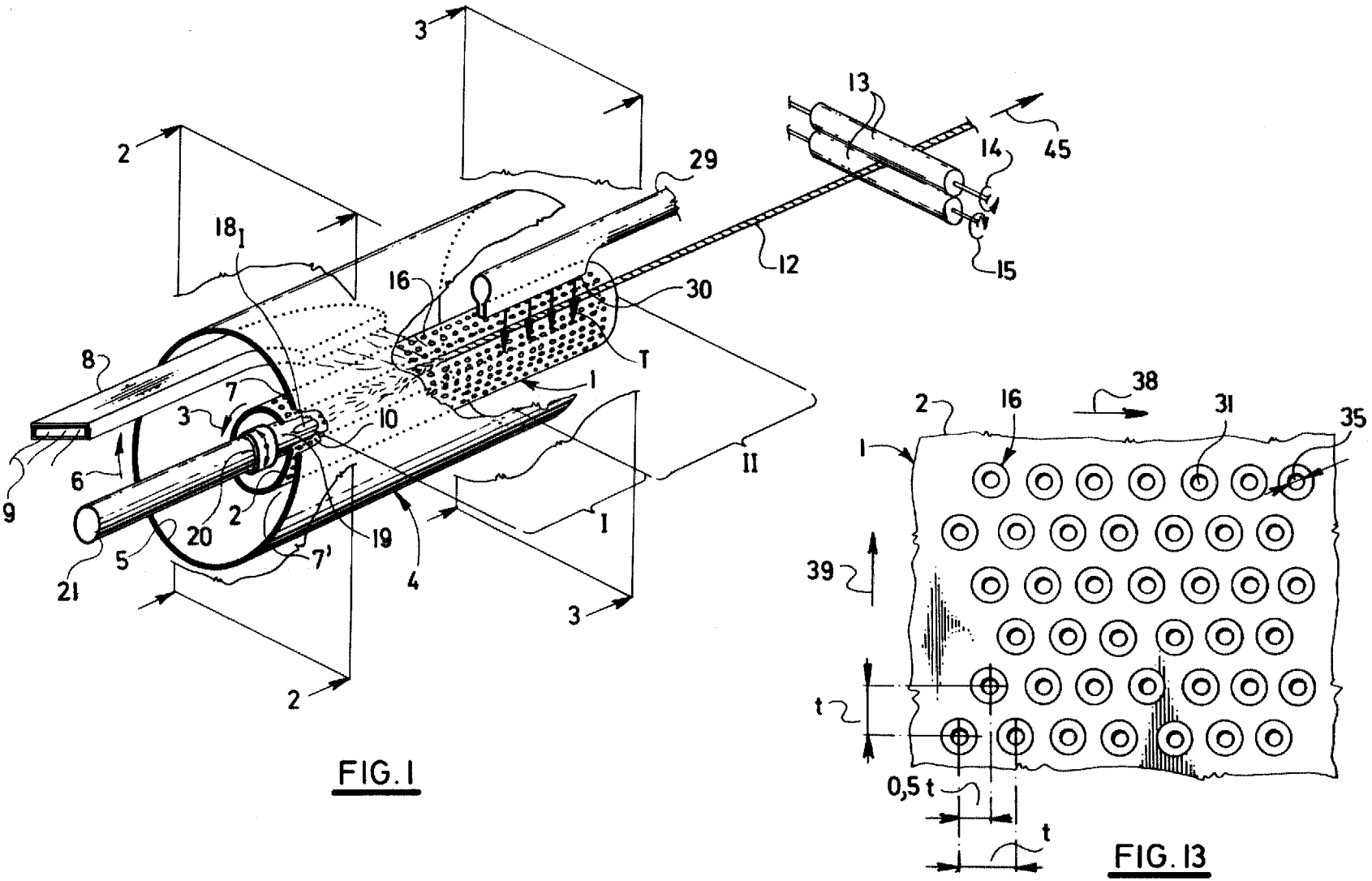
FIG. 1 is a perspective and partially sectional view of the first illustrative embodiment of the invention.
Figure 16:
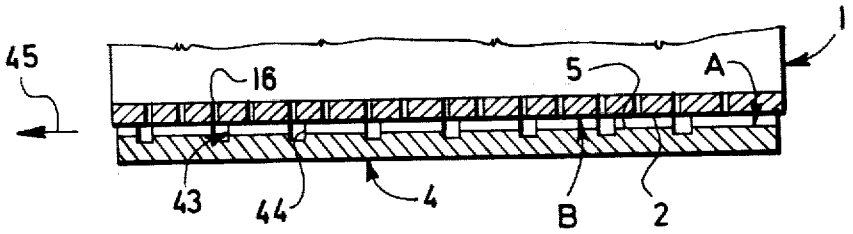
Figure 17:
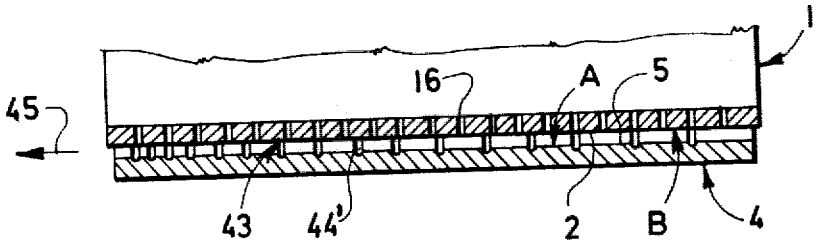
Figure 15:
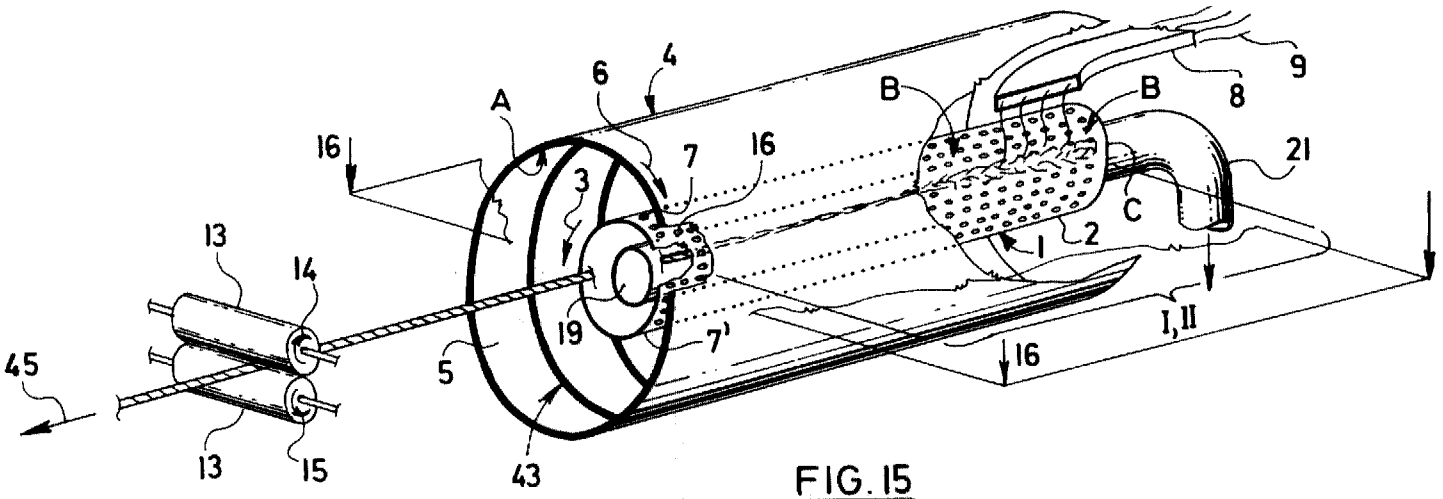
Figure 14:
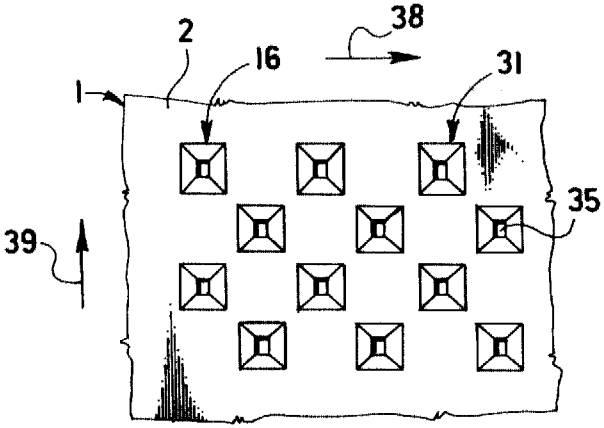
Figure 12:
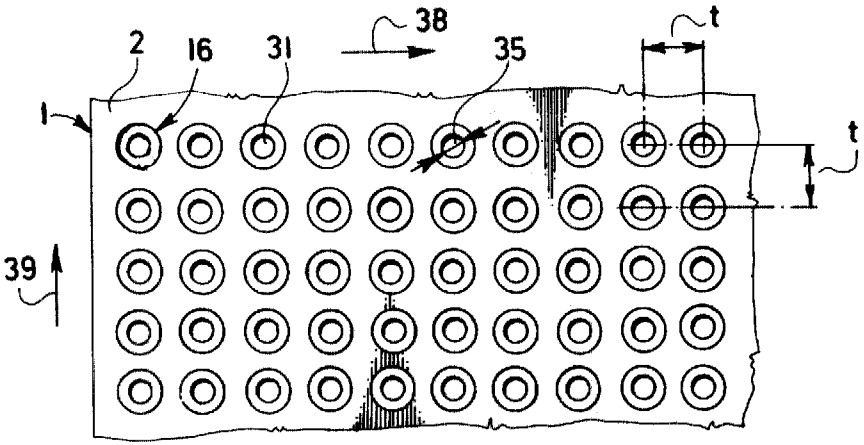

FIGS. 12 to 14, inclusive, are fragmentary views of various hole patterns on a perforated area of the frictional surface rolled out on a plane;

FIG. 15 is a partly perspective and partly sectional view of the spinning unit with roughening means;

FIG. 16 is an enlarged sectional view of the two carriers, taken along the line 16—16 in FIG. 15; and FIG. 17 is a longitudinal sectional view of another alternative embodiment of the carriers.

Figure 2:
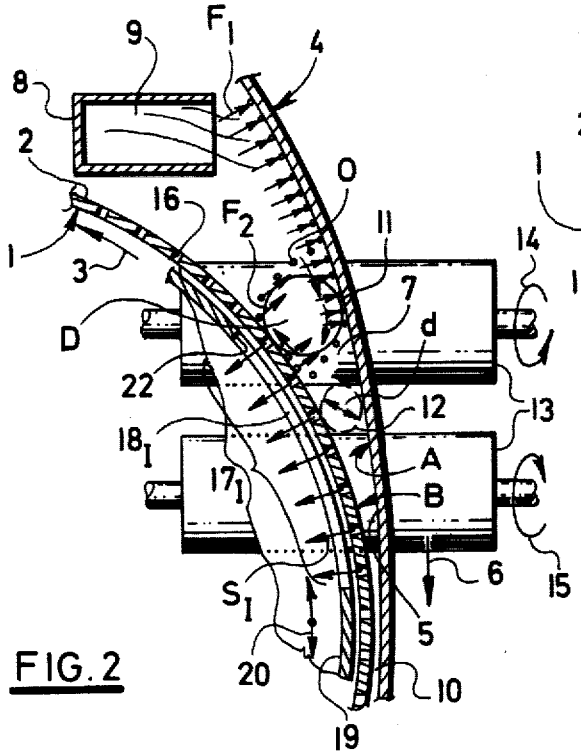
FIG. 2 is an enlarged vertical sectional view taken along the line 2—2 in FIG. 1.
Figure 5:
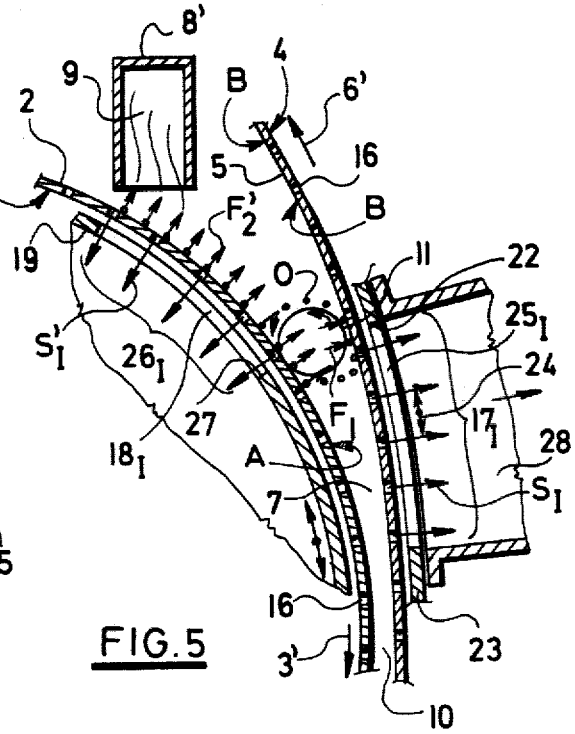
FIG. 5 is a view similar to FIG. 4 of another alternative embodiment.
Figure 4:
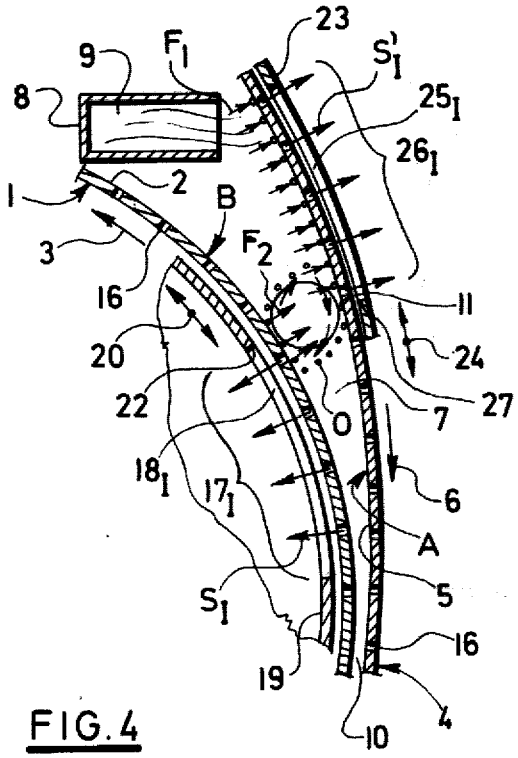
FIG. 4 is a vertical sectional view of an alternative embodiment, taken through the carriers in the yarn preforming region.
Figure 3:
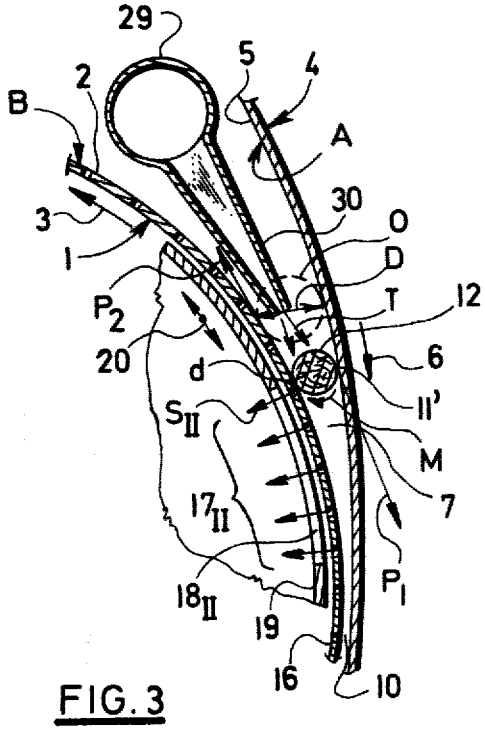
FIG. 3 is an enlarged vertical sectional view taken along the line 3—3 in FIG. 1.
Figure 6:
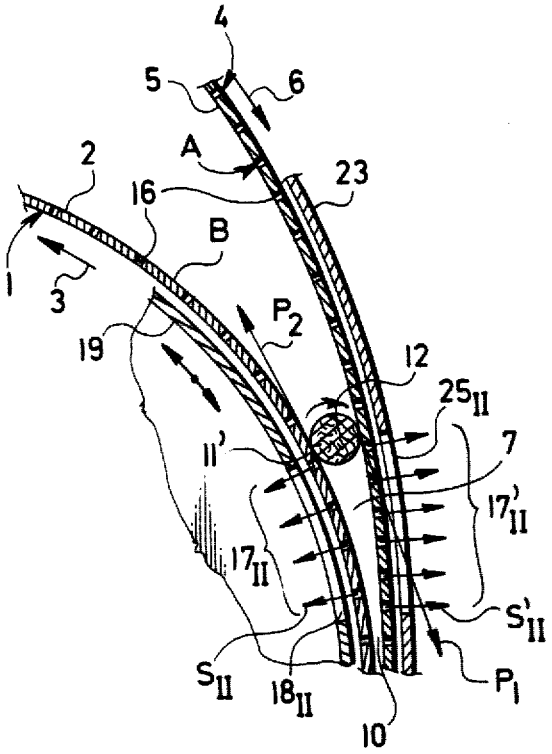
FIG. 6 is a vertical sectional view of an alternative embodiment, taken through the yarn finishing region.
Figure 7:
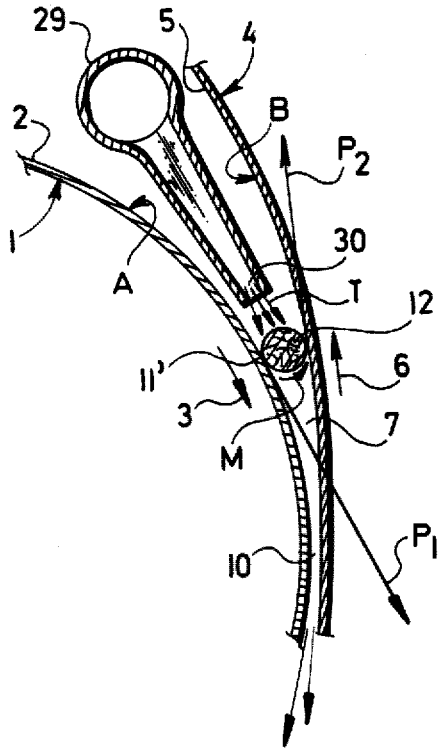
FIG. 7 is a vertical sectional view of another alternative embodiment, taken through the yarn finishing region.

As is apparent from the above, seven principal embodiments of the spinning unit are illustrated: embodiment 1 in FIGS. 1, 2, and 3; embodiment 2 in FIG. 4; embodiment 3 in FIG. 5; embodiment 4 in FIG. 6; embodiment 5 in FIG. 7; embodiment 6 in FIGS. 15 and 16; and embodiment 7 in FIG. 17. Four different cross-sectional configurations of the holes in the carrier are shown in FIGS. 8–11, inclusive, respectively. Three embodiments of the perforated area of the frictional surface are shown in FIGS. 12–14, inclusive, respectively.

Turning first to FIGS. 1, 2 and 3 there is there shown a perspective view of operating elements of a frictional open-end spinning unit comprising an inner carrier 1 having an outer frictional surface 2 and rotatable in the direction of arrow 3. The inner carrier 1 is received in an outer carrier 4 having an inner frictional surface 5 and rotatable in the opposite direction indicated by arrow 6. The two frictional surfaces 2 and 5 of the carrier 1 and 4, respectively, the latter of which, embodied as hollow cylinders with parallel longitudinal axes (not shown), are associated closely but in contactless manner with each other so as to provide two opposite wedge-like gaps 7, 7' of which the gap 7 is designed for performing the actual spinning process (FIG. 2).

Into the cavity of the outer carrier 4, a duct 8 extends through which fibers 9 are supplied from a fiber separating mechanism (not shown) onto one of the two frictional surfaces 2 and 5. That one of the frictional surfaces 2, 5 which supplies the fibers into the wedge-like gap 7 will hereinafter be referred to as the frictional carrying surface A and the other as the second frictional surface B.

It results from the foregoing that for carrying out the actual spinning process only that wedge-like gap is designed into which the fibrous material is supplied by the frictional carrying surface A.

The wedge-like gap 7 is defined, on the one hand, by its apex 10 in which the two frictional surfaces most closely approach each other, and, on the other hand, by its mouth 11 (FIG. 2) in which, due to an interaction between the frictional surfaces 2, 5, fibers are twisted to yarn. The position and width of said mouth 11 may vary along the wedge-like gap 7, depending upon the diameter of the bundle of fibers to be twisted to yarn, which diameter in a yarn preforming region I does not correspond to that in a yarn finishing region II (FIG. 1). The region I is a section of the wedge-like gap 7 which substantially corresponds to the region of the frictional carrying surface A onto which the separated fibers are supplied from the fiber separating mechanism through the duct 8. The fiber preforming region I is followed by the yarn finishing region II in which the fiber bundle is twisted to yarn.

The duct 8 is oriented so as to deposit the fibers 9 onto the inner frictional surface 5 which, in this embodiment, is the frictional carrying surface A supplying the fibers 9 into the mouth 11 of the wedge-like gap 7 where they are accumulated and twisted by counterdirectionally rotating frictional surfaces 2 and 5 to yarn 12 to be withdrawn from the wedge-like gap 7 in a direction substantially perpendicular to that rotation of the two carriers 1 and 4 by means of a pair 13 of take-off rollers, and wound in a spooling device on a bobbin to form a package. The directions of rotation of the take-off rollers of pair 13 are indicated by respective arrows 14 and 15.

The frictional surface 2 of the inner carrier 1 is provided, along the entire carrier length comprising the regions I and II, with perforations 16. On the frictional surface 2 which, in this case, constitutes the second frictional surface B, a suction field $17_I$ is provided, which field is situated in the wedge-like gap 7. The suction field $17_I$ which is sharply defined in the mouth 11 of the wedge-like gap 7 and which terminates, as a rule, in the apex 10, is formed by the mouth of a suction nozzle or by an orifice $18_I$ in a shutter 19, the position of the latter of which being adjustable by means not shown in the direction of double-headed arrow 20 in the cavity of the inner carrier 1. Said carrier 1 communicates via a hose 21 with a subatmospheric pressure source. In this case, the carrier 1 assumes the function of a known perforated or screen drum. The edge 22 of the shutter 19 extends either within the entire region of the shutter 19 in parallel with the axis (not shown) of the inner carrier 1, or extends in correspondence with the width of the mouth 11 of the wedge-like gap 7, the latter of which is wider in the yarn preforming region I than in the yarn finishing region II.

The fibers 9 supplied via duct 8 from the separating mechanism (not shown) or, alternatively, by means of an air flow, are deposited onto the frictional carrying surface A where they are held due to a frictional or adhesion force exerted by a centrifugal force. The fibers are carried along with the frictional carrying surface A toward the wedge-like gap 7. In the yarn preforming region I, the fibers having passed the mouth 11 of the wedge-like gap 7, are exposed to the suction field $17_I$ which transfers them from the frictional carrying surface A onto the second frictional surface B and holds them on said perforated surface B which conveys the fibers out of the wedge-like gap 7. After having passed the mouth 11 defining the suction field $17_I$, the released fibers are hurled off by the centrifugal force exerted by the inner carrier 1, in substantially radial direction up to the frictional carrying surface A which carries the fibers in turn into the wedge-like gap 7 up to downstream of its mouth 11 where they are exposed again to the suction field $17_I$. Thus the cycle is repeated in such a way that the fibers in the mouth 11 of the wedge-like gap 7 shuttle to and fro between the frictional carrying surface A and the second frictional surface B. The latter carries them away from the wedge-like gap 7 while close downstream of its mouth 11 they land again on the frictional carrying surface A. In this way the fibers substantially follow an endless circular path between the two frictional surfaces 2 and 5 in the region of the mouth 11 of the wedge-like gap 7, and are continuously wrapped up onto an open end of the yarn 12 being twisted in the yarn finishing region II and withdrawn from the wedge-like gap 7 by the take-off rollers 13. The arising twist retained along the nip line of the take-off rollers 13 retreats back to the yarn open-end.

FIG. 2 shows the forces involved in the spinning process. On the frictional carrying surface A, the fibers are held by a frictional force exerted by a first centrifugal force $F_1$ on outer carrier 4 and the surface A. Downstream of the mouth 11 of the wedge-like gap 7, said force $F_1$ is overcome by a second force, i.e. suction force $S_I$ exerted by the suction field $17_I$ and directed radially toward the second frictional surface B. The suction force $S_I$ urges the fibers to the second frictional surface B which carries them out of the wedge-like gap 7. Having passed the mouth 11, the fibers are exposed to a third force exerted by a centrifugal force $F_2$ which, in the region of the wedge-like gap 7, has been fully cancelled by the suction force $S_I$. The force $F_2$ drives the fibers outwardly substantially in a radial direction toward the frictional carrying surface A, the fibers being stopped by said surface A where they begin to be engaged by a third force, which is again exerted by the centrifugal force $F_1$ which now does not have to counter suction force $S_1$. Thus the fibers revolve around an ideal circular patch 0 situated in the region of the mouth 11 of the wedge-like gap 7. The width of the mouth 11, depending upon the count of the yarn to be spun, is adjusted by a corresponding position of the shutter 19 which defines the suction effect of the field $17_I$ in the wedge-like gap 7.

During the transition of the fibers from one frictional surface to the other, there occurs, due to the yarn take-off, a progressive overlapping of the arising fiber layers over one another as well as an effective cyclic fibers assembling whereby optimum conditions for spinning structurally excellent yarn are established.

Since the afore-described frictional open-end spinning system is a low-speed one (which means that the carriers rotate at a low speed, e.g. relative to the speed of spinning rotor), the action of the centrifugal force $F_2$, and particularly that of the frictional force exerted by the centrifugal force $F_1$, are also relatively small. A minor force $F_2$ is beneficial to the spinning process since it does not reduce too much the counteraction of the suction force $S_I$ on the corresponding frictional surface.

It is desirable that the action of the frictional force excited by the centrifugal force $F_1$ be higher, especially when processing fibers of relatively low specific weight. Such an increase can be, for example, achieved by raising the peripheral speed of the frictional surface 5 relative to that of the frictional surface 2 whereby the centrifugal force $F_1$ and consequently also the frictional force acting on the frictional surface 5 upstream of the mouth 11 of the wedge-like gap 7, will increase.

The efficiency of imparting twists into the yarn being formed can be raised by involving a fourth force by which the yarn in the finishing region II is driven into the wedge-like gap 7 whereby a desirable influence of the frictional forces of the frictional surfaces 2 and 5 on the production of yarn torque is achieved.

The fourth force is constituted, for instance, by an air flow urging the yarn being formed into the mouth 11' of the wedge-like gap 7 toward the apex 10.

An exemplary embodiment is shown in FIGS. 1 and 3. Into the cavity of the outer carrier 4, a nozzle 29 extends which is connected to a superatmospheric pressure air source (not shown). The longitudinal mouth 30 of said nozzle 29 which is parallel to the longitudinal axis (not shown) of the outer carrier 4 is adjusted in such a position that a pressure force T is directed to the surface of the yarn 12 being formed in the wedge-like gap 7 in the yarn finishing region II.

Thus apart from the suction force $S_{II}$ of the field $17_{II}$ situated downstream of the mouth 11' of the wedge-like gap 7, the yarn being formed is also influenced by the superatmospheric pressure air the components of which urge the yarn into the wedge-like 7 and thereby onto the two frictional surfaces 2 and 5.

By urging the yarn onto the two frictional surfaces 2 and 5, an efficient rolling of yarn on said frictional surfaces is ensured, due to an appropriate transmission ratio between the yarn diameter d and the diameters of the frictional surfaces. In this way it is possible to substantially raise the twist imparting effectiveness so that the system is operable at relatively very high take-off speeds, when considering usual twist rates.

FIG. 4 shows a cross-sectional view taken through the yarn preforming region I. The embodiment shown in FIG. 4 distinguishes from that shown in FIG. 2 in that the outer carrier 4 is also provided with the perforation 16. On the outer wall of the outer carrier 4, a shutter 23 bears the position of which is adjustable in the direction of double-headed arrow 24. The orifice $25_I$ of the shutter 23 is situated so that an auxiliary suction $26_I$ on the perforated frictional surface 5 is provided upstream the mouth 11 of the wedge-like gap 7, the edge 27 of the orifice $25_I$ of the shutter 23 being in the region of the mouth 11. The solid portion of the shutter 23 masks the section of the wedge-like gap 7 downstream its mouth 11.

During the rotation of the outer carrier 4 there is excited on the frictional surface 5, due to self-ventilation of the auxiliary suction field $26_I$, a third force constituted by a suction force $S_I'$ co-acting with the centrifugal force $F_2$.

In the embodiment according to FIG. 5, the rotational directions 3' and 6' of the two carriers 1 and 4, respectively, are opposite relative to directions 3 and 6 indicated in FIGS. 2 and 3.

The duct 8' supplies the fibers 9 onto the frictional carrying surface A which, in this case, is constituted by the frictional surface 2 of the inner carrier 1 provided with the perforation 16. The shutter 19 is adjusted in such a position that the auxiliary field $26_I$ producing the suction force $S_I'$ is situated in a region upstream of the mouth 11 of the wedge-like gap 7.

Close to the outer wall of the outer carrier 4 provided with the perforation 16 there is arranged the shutter 23 the orifice $25_I$ of which faces a suction nozzle 28 communicating with a subatmospheric pressure source. The orifice $25_I$ defines on the second frictional surface B the suction field $17_I$ producing the suction force $S_I$ downstream of the mouth 11 of the wedge-like gap 7 toward its apex 10.

The fibers supplied on to the frictional carrying surface A are held thereon by the suction force $S_I'$ of the auxiliary suction field $26_I$ situated on the frictional surface 2 of the inner carrier 1 upstream the mouth 11 of the wedge-like gap 7. The fibers having passed the mouth 11 are exposed to the suction force $S_I$ of the suction field $17_I$ and to the centrifugal force $F_2'$ which has been fully cancelled upstream of the mouth of the wedge-like gap by the action of the suction force $S_I'$. This force action, immediately downstream of the mouth 11, transfers the fibers onto the second frictional surface B which carries them away from the wedge-like gap 7 by the frictional force excited by the suction force $S_I$ and by the centrifugal force $F_1$. Upstream of the mouth 11, the fibers are exposed again to the suction force $S_I'$ of the auxiliary suction field $26_I$, which force transfers them again onto the frictional carrying surface A whereupon the cycle is repeated. The direction of fiber movement around the circular path O is in this case opposite relative to that shown in FIG. 4.

According to an alternative embodiment which distinguishes from that shown in FIG. 5, it is possible to omit the suction nozzle 28. In this case the first force is constituted by a suction force exerted by self-ventilation of the perforated frictional surface 5 in the region of the mouth 11 of the wedge-like gap 7.

The circular path O circumscribed by the fibers in the yarn preforming region I has a diameter D which is many times larger than a nominal yarn diameter d (FIG. 2) from which also the corresponding width of the mouth 11 of the wedge-like gap 7 results.

With regard to the course of the spinning process in the wedge-like gap 7, the yarn 12 in the yarn finishing region II is nearer to the gap apex 10 than the mass of cyclically overlapping fiber layers in the yarn preforming region I, which layers revolve aroung the path O.

The yarn rolling principle is schematically illustrated in FIG. 3 showing the cross-sectional view of the wedge-like gap 7 in the yarn finishing region II, taken along the line 3—3 in FIG. 1. In this case, the wedge-like gap 7 is defined by the mouth 11' which corresponds to the diameter d of the yarn 12. For the sake of clarity, also the circular path O having the diameter D is shown by thin dash-line in the mouth 11 of the wedge-like gap 7, the path corresponding to the sectional view taken along the line 2—2 in FIG. 1, i.e. to the yarn preforming region I. On the one hand, the yarn is sucked into the wedge-like gap 7 by the suction force $S_{II}$ of the field $17_{II}$ and, on the other hand, urged by the pressure force T of the technological pressurized air. This is why the yarn being formed is in the region of the two frictional surfaces 2 and 5 in an intense contact with said surfaces whereby frictional forces $P_1$ and $P_2$ are exerted along the contact lines, which forces turn the yarn around its longitudinal axis, and finally twist it by applying the torque M.

The substantially same effect is attainable in any case when the yarn is exposed to a force which causes it to come into contact with the two frictional surfaces but which does not prevent it from rotating. An exemplary embodiment illustrating this is schematically shown in FIG. 6, which is a cross-sectional view of a system (not shown) in the yarn finishing region II.

In this embodiment, two carriers 1 and 4 are provided with perforation 16. Inside the inner carrier 1 which assumes the function of a suction screen drum, a shutter 19 is received of which the orifice $18_{II}$ defines the auxiliary suction field $17_{II}$ in the wedge-like gap 7 downstream of its mouth 11'. The suction effect is indicated by the suction force $S_{II}$.

The shutter 23 bears on the outer wall of the outer carrier 4 in the yarn finishing region II; the orifice $25_{II}$ of the shutter defines, on the frictional surface 5 of the outer carrier 4 downstream of the mouth 11', the auxiliary suction field $17_{II}'$ indicated by the force $S_{II}'$.

The yarn being twisted in the mouth 11' of the wedge-like gap 7, due to the contact with the two frictional surface 2 and 5, is sucked into said gap by a subatmospheric pressure produced in said gap by the suction force $S_{II}$ of the field $17_{II}$ and by the suction force $S_{II}'$ exerted by self-ventilation of the frictional surface 5 in the field $17_{II}'$. The frictional surfaces 2 and 5 in the yarn preforming region I can be embodied, for example, as shown in FIG. 2 or FIG. 3.

Another exemplary embodiment exhibiting practically the same effect is shown in FIG. 7. The two frictional surfaces 2 and 5 are unperforated in the yarn finishing region II. The yarn preforming region I on the two frictional surfaces 2 and 5 can be embodied, for example, as shown in FIG. 5.

The yarn being twisted in the mouth 11' of the wedge-like gap 7, due to the contact with the two frictional surfaces 2 and 5 in the yarn finishing region II, is urged into the wedge-like gap 7 by the pressure force T of technological air blown from the longitudinal mouth 30 of the nozzle 29.

Due to the mutual contact of yarn with the frictional surfaces 2 and 5, frictional forces $P_1$ and $P_2$ are exerted which impart to the yarn the final twist based upon the torque M having the same direction as that of the fiber movement around the circular path O.

Similarly, it is possible to provide another alternative embodiment wherein the suction field is situated only on one of the two frictional surfaces 2 and 5, or to concentrate the suction effect into the apex 10 of the wedge-like gap 7 by an additional suction hose, or the like. In such embodiment which is particularly preferable for imparting final twist to extra fine yarn types, forces $P_1$ and $P_2$ are exerted, having a subsequent torque M for imparting twists to the yarn 12. The force $P_1$ is a frictional surface acting on the frictional carrying surface A.

An advantage of this process of imparting final twist to the yarn on the frictional surfaces having the same characteristics is that the yarn, at least in the yarn finishing region II, is nearer to the apex 10 of the wedge-like gap 7 than is the position of the center of the circular path O circumscribed by fibers of the yarn open-end in the yarn preforming region I.

The amount of the frictional force which is the resultant of the frictional forces $P_1$ and $P_2$ can be also raised, and particularly either by a higher peripheral friction on the frictional carrying surface A, or by increasing the peripheral speed of the frictional carrying surface A relative to that of the second frictional surface B, or by a combination of both. The peripheral friction on the frictional carrying surface A can be raised by a suitable superficial finish such as, for instance, by sand blasting, anodization, plasma spray, or, alternatively, by applying a layer of a substance having a high coefficient of friction such as, e.g., "Vulcollan" (reg. Trade Mark), technical rubber, or the like.

In this way the frictional force $P_1$ rises, and the resultant of the forces $P_1$ and $P_2$ thrusts the yarn more forcibly onto the frictional surfaces 2 and 5 of the carriers 1 and 4, respectively, whereby still more effective rolling of the yarn occurs in the mouth 11' of the wedge-like gap 7.

FIGS. 8 to 11, inclusive, show schematically various embodiments of perforations of the frictional surface of one or both of the carriers 1 and 4, all such views being cross-sectional views of the respective carrier. The cross-sectional views of the frictional surface 2 of the carrier 1 together with the shutter 19 are taken through the yarn preforming region I.

The perforation 16 is formed by holes 31 defined by inlet 32, outlet 33, profile area 34 constituting a section perpendicular to the (not shown) axis of the hole 31, nominal profile area 35 which is the smallest of all the profile areas, and wall 36 of the hole 31.

Figure 8:
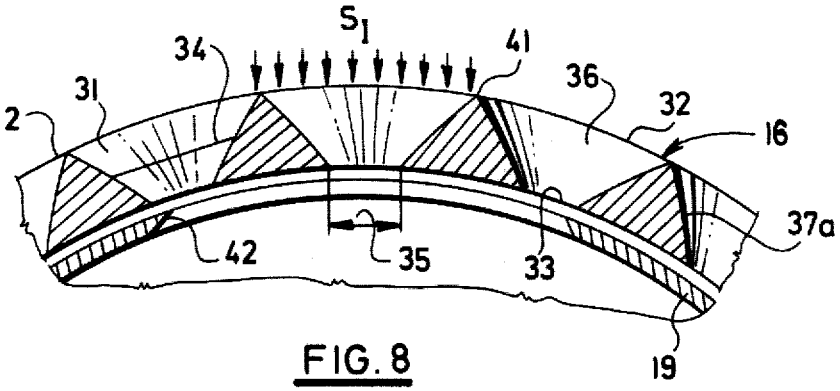

In the embodiment shown in FIG. 8, the nominal profile area 35 is provided at the outlet 33, the wall 36 being a surface of rotation the generatrix of which is constituted by an arcuate curve 37*a*. The suction force $S_f$ acts on the frictional surface 2 in the regional surface 2 in the region of the inlets 32 of the holes 31.

From the viewpoint of the manufacture, the profile arena 34 should preferably be defined by a circle.

Figure 9:
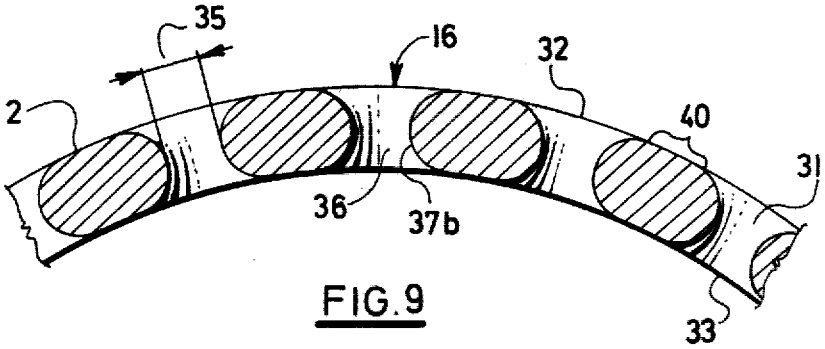

In FIG. 9, holes 31 are shown, the nominal profile area 35 of which is provided at a half-height of the holes 31, the profile area 34 increasing from this central portion defined by the nominal profile area 35 toward the inlet 32 and the outlet 33. The wall 36 is also a surface of rotation the generatrix of which is the arcuate curve 37*b*.

Figure 10:
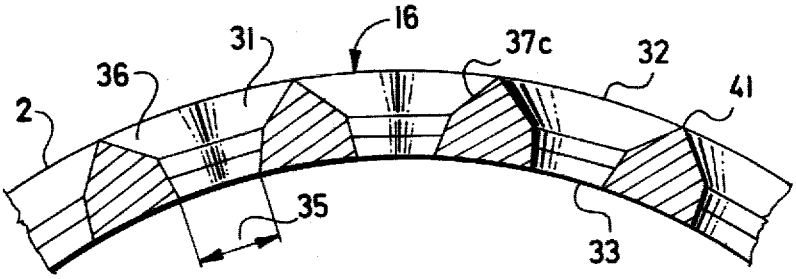

FIG. 10 shows holes 31 the nominal area 35 of which is provided at the outlet 33, the wall 36 being a surface of rotation of which generatrix is composed of several linear sections 37*c*.

The generatrix can be, alternatively, constituted by at least one curvilinear and at least one linear section.

Figure 11:
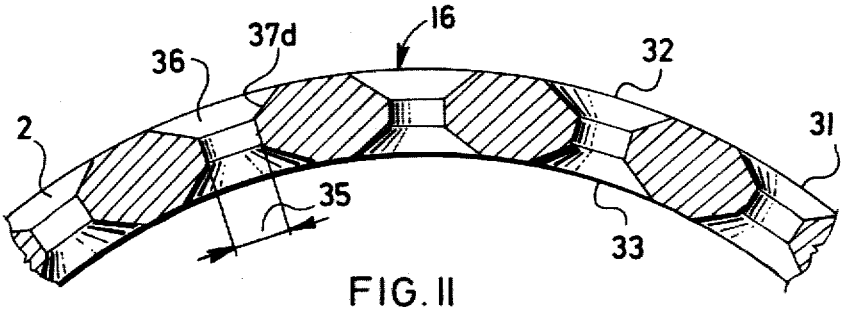

FIG. 11 shows holes 31 the nominal area 35 of which is provided in the central part of the hole height. The wall 36 is a surface of rotation the generatrix of which consists of several linear sections 37*d*.

The advantage of the described arrangement of the holes 31 of perforation 16 resides in that the technological air is sucked in through holes 31 on their maximum profile area so that at a given air throughflow, an increase of active suction area of the carriers 1 and 4 is achieved.

The specific distribution of the holes 31 of perforation 16 on the surface of one or both carriers 1, 4 (FIGS. 12 to 14, inclusive) provides a frictional surface with maximum suction effect.

The spacings t of the holes 31 on the frictional surface of one or both carriers 1, 4 should preferably be the same both in the longitudinal direction indicated by arrow 38 and the peripheral direction indicated by arrow 39 as shown in FIG. 12 illustrating a portion of the frictional surface 2 of the carrier 1 rolled out on a plane.

Another preferred distribution pattern of the holes is shown in FIG. 13 in which the spacings t of the holes 31 are staggered in the longitudinal direction by 0.5 t.

A perforation 16 with non-circular openings is shown in FIG. 14.

It is also advantageous, when the spacings t of holes 31 are arranged in the longitudinal and/or peripheral directions 38 and 39, respectively, that between adjacent holes 31 there is a minimum distance which, however, should not be larger than the hole diameter, or the maximum dimension of the nominal profile area 35.

As apparent from FIG. 9, such distance 40 between the holes 31 is equal to the diameter of the nominal profile 35.

An embodiment which is advantageous from the viewpoint of obtaining maximum suction effect area with circular holes 31, is shown in FIG. 8 and 10 wherein the holes 31 on the frictional surface 2 are defined by an edge 41.

The transition area between the holes 31 can be also continuous, smooth or rounded.

With the spacing t of the holes 31 distributed in accordance with FIG. 13, the minimum distance 40 between the holes 31 in the longitudinal and/or peripheral directions 38 and 39, respectively, can be enlarged up to three times the dimension of the nominal profile area 35, as shown in FIG. 11.

To reduce air transition losses, the edges of the orifice in the shutter 19 can be appropriately chamfered, as shown in FIG. 8 at 42.

By the aformentioned modifications of the holes 31 and of the expedient distribution on the frictional surface of one or both carriers 1 and 4, the suction effect can be provided almost over the entire frictional surface with a minimum number of holes 31 of perforation 16 and consequently with a minimum consumption of technological subatmospheric pressure air.

The perforation 16 can be manufactured by using conventional means.

It is desirable that in the area C-D (FIG. 15) which comprises the yarn preforming region I, the yarn finishing region II and the distance between the outlet of the wedge-like gap 7 and the nip line of the take-off rollers 13, the frictional force acting against the yarn take-off and ensuring, during the spinning process, a constant position of the yarn being formed in the wedge-like gap 7, be substantially enhanced. Such a frictional force increase can be achieved by roughening means 43, provided especially on the frictional carrying surface A.

FIG. 16 shows a longitudinal sectional view of the two carriers 1, 4 taken along the plane 16—16 in FIG. 15. On the frictional carrying surface A there are provided peripheral circular grooves 44 uniformly spaced from each other.

Alternatively, FIG. 17 shows the same view as FIG. 16, except that the density of the circular grooves 44' increases in the yarn take-off direction indicated by arrow 45.

The purpose of the aforementioned increase in density of the roughening means in the yarn take-off direction is to raise the frictional force acting longitudinally between the yarn being formed and the frictional surfaces of the carriers.

The roughening means can be embodied in various ways. Preferably, they can be made as annular, or helical grooves, notches, or in the form of an appropriate superficial finish as hereinabove referred to.

To achieve the desired degree of axial tension in the yarn being withdrawn, the degree of roughening should preferably rise in the direction of yarn take-off out of the wedge-like gap. For this purpose, the density of the roughening means, such as annular grooves, should increase in the yarn take-off direction. When using helical grooves their thread pitch should correspondingly decrease in this direction.

In the above specification and the accompanying drawings, there have been described and shown, respectively, the operational parts of the system only from the viewpoint of understanding the subject matter of the invention. In the examplary embodiments, the carriers of the frictional surfaces are made as cylinders with parallel axes. However, the objects of the invention could be also met if the carriers have the shape of conical bodies. Thus, for instance, at least one of the frictional surfaces can be provided on a carrier in the form of a hollow frustum of a cone.

In the exemplary embodiments, the space between the cylinders in the wedge-like gap apex is shown as being the same along the entire cylinder length. However, the inventive object will also be complied with if such space, both with cylindrical and aforementioned conical carriers, varies along the carrier length. Thus, for example, it is advantageous for the spinning process when the space between the frictional surfaces, at least in the wedge-like gap apex, progressively decreases in the yarn take-off direction. Although such cases have not been shown in the preferred embodiments of the invention, they are deemed obvious.

The object of the invention is also met when the circular path O of fibers in the yarn preforming region is formed by the actions of the above-described first and second forces while one of them is exerted by a pressure force excited by a pressure field via perforation of the frictional surfaces, due to a pressure air supplied through a nozzle closely bearing, from the opposite side, on said perforated frictional surface in the wedge-like gap region. The definition of such field is given by the desired actions of the first, second, or alternatively, even the third force for forming said circular path.

The drive and structure of the individual operative elements, even those here not described and not shown, has sufficiently been explained in the above-mentioned German published application /DE-OS/ No. 2,809,599.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a method of frictional spinning based upon the open-end principle, comprising depositing continuously supplied separated fibers onto a frictional carrying surface provided on a revolving carrier and designed for conveying the fibers to the mouth of a wedge-like gap defined by said frictional carrying surface and a second frictional surface provided on a second revolving carrier moving in said wedge-like gap in the opposite direction relative to the frictional carrying surface, twisting the fibers to yarn in the wedge-like gap due to the contact with said frictional surfaces, and withdrawing the yarn from said gap in a lateral direction while preventing twist propagation, the improvement wherein the wedge-like gap has a yarn preforming region followed by a yarn finishing region, the fibers supplied by the frictional carrying surface into the wedge-like gap are transferred, in the yarn preforming region, immediately downstream of the mouth of the wedge-like gap, by the action of a first force, onto said second frictional surface, from which the fibers after having left the wedge-like gap, are transferred again by the action of a second force to said frictional carrying surface upstream of the mouth of said wedge-like gap, whereby the fibers are positively caused to circulate in the yarn preforming region.

2. A method as claimed in claim 1, wherein the first force is exerted by a suction field on the second frictional surface downstream of the mouth of the wedge-like gap.

3. A method as claimed in claim 1, wherein the second force is exerted by a centrifugal force to which the fibers are exposed on the convex frictional surface.

4. A method as claimed in claim 3, wherein the centrifugal force coacts with a third force exerted by an auxiliary suction field on the convex frictional surface upstream of the mouth of the wedge-like gap.

5. A method as claimed in claim 1, wherein the second force is exerted by the suction field on the concave frictional surface upstream of the mouth of the wedge-like gap.

6. A method as claimed in claim 1, wherein the yarn being twisted in the wedge-like gap in the yarn finishing region is driven into the wedge-like gap by the action of a fourth force.

7. A method as claimed in claim 6, wherein the fourth force is exerted by an air stream forcing the yarn being produced into the wedge-like gap.

8. A method as claimed in claim 6, wherein the fourth force is exerted by a subatmospheric pressure produced in the wedge-like gap.

9. A method as claimed in claim 8, wherein the subatmospheric pressure is produced by additional suction fields situated on the two frictional surfaces in the wedge-like gap.

10. A method as claimed in claim 6, wherein the fourth force is exerted simultaneously by an air stream and a subatmospheric pressure produced in the wedge-like gap.

11. In an apparatus for frictional spinning based upon the open-end principle, including means for depositing continuously supplied separated fibers onto a frictional carrying surface provided on a revolving carrier and designed for conveying the fibers to the mouth of a wedge-like gap defined by said frictional carrying surface and a second frictional surface provided on a second revolving carrier and moving in said wedge-like gap in the opposite direction relative to the frictional carrying surface, means for twisting the fibers to yarn in the mouth of the wedge-like gap due to the contact with said frictional surfaces, and means for withdrawing the yarn from said gap in a lateral direction while preventing twist propagation, the improvement wherein the wedge-like gap has a yarn preforming region followed by a yarn finishing region, and the second frictional surface is perforated at least in the yarn preforming region and comprising a suction field downstream of the mouth of the wedge-like gap, said suction field being sharply defined in said mouth of the wedge-like gap, said suction field transferring the fibers from the frictional carrying surface onto the second frictional surface, the frictional carrying surface being perforated at least in the yarn preforming region, a suction field being disposed upstream of the mouth of the wedge-like gap for transferring the fibers upstream of the wedge-like gap from the second frictional surface onto the first frictional carrying surface.

12. In an apparatus for frictional spinning based upon the open-end principle, including means for depositing continuously supplied separated fibers onto a first frictional carrying surface provided on a first revolving outer carrier and designed for conveying the fibers to the mouth of a wedge-like gap defined by said first frictional carrying surface and a second frictional surface provided on a second inner revolving carrier disposed within the outer carrier and moving in said wedge-like gap in the opposite direction relative to the frictional carrying surface, means for twisting the fibers to yarn in the mouth of the wedge-like gap due to the contact with said frictional surfaces, and means for withdrawing the yarn from said gap in a lateral direction while preventing twist propagation, the improvement wherein the wedge-like gap has a yarn preforming region followed by a yarn finishing region, and on the second frictional surface which is constituted by the frictional surface of the inner carrier and which is perforated at least in the yarn preforming region a suction field is provided downstream of the mouth of the wedge-like gap in the yarn preforming region, said field being sharply defined in said mouth of the wedge-like gap, for transferring the fibers from the first frictional carrying surface, constituted by the frictional surface of the outer carrier, onto the second frictional surface of the inner carrier from which the fibers, after having been carried off the wedge-like gap, are transferred by centrifugal force back onto the first frictional surface of the outer carrier.

13. An apparatus as claimed in claim 12, wherein upstream of the mouth of the wedge-like gap, at least in a part of the yarn finishing region, a blowing nozzle is provided for forcing the yarn into the wedge-like gap.

14. An apparatus as claimed in claim 12, wherein downstream of the mouth of the wedge-like gap, in the yarn finishing region, an additional suction field is provided on the second frictional surface for producing a subatmospheric pressure in the wedge-like gap.

15. An apparatus as claimed in claim 12, wherein the two frictional surfaces are unperforated in the yarn finishing region.

16. An apparatus as claimed in claim 12, wherein the two frictional surfaces are perforated in the yarn finishing region, and an additional suction field is provided downstream of the mouth of the wedge-like gap for producing a subatmospheric pressure in the wedge-like gap.

17. An apparatus as claimed in claim 12, wherein the perforation of at least one of the frictional surfaces is formed by holes the profile area of which increases, beginning from a nominal profile area thereof in the direction toward the inlet of the holes.

18. An apparatus as claimed in claim 17, wherein the nominal profile area in the middle portion of the height of the holes is smaller than the profile area at the inlet of the holes.

19. An apparatus as claimed in 17, wherein the wall of the holes is a surface of rotation.

20. An apparatus as claimed in claim 19, wherein the generatrix of the surface of rotation is an arcuate curve.

21. An apparatus as claimed in claim 17, wherein the spacings between the holes are identical both in the longitudinal direction and peripheral direction of the frictional surfaces.

22. An apparatus as claimed in claim 17, wherein the spacings between the holes are staggered in the longitudinal direction.

23. An apparatus as claimed in claim 17, wherein the spacings between the holes are staggered in the peripheral direction.

24. An apparatus as claimed in claim 17, wherein the smallest distance between the holes at most equals the maximum dimension of the nominal profile area.

25. An apparatus as claimed in claim 17, wherein the smallest distance between the holes at most equals to the treble dimension of the nominal profile area.

26. An apparatus as claimed in claim 17, wherein at least on the frictional carrying surface of the two frictional surfaces, at least in the yarn finishing region, roughening means are provided for raising the coefficient of friction of the frictional surface.

27. An apparatus as claimed in claim 26, wherein the density of the roughening means increases in the direction of yarn withdrawal from the wedge-like gap.

28. An apparatus as claimed in claim 26, wherein the roughening means are annular grooves.

29. An apparatus as claimed in claim 28, wherein the density of the annular grooves increases in the direction of yarn withdrawal from the wedge-like gap.

30. An apparatus as claimed in claim 26, wherein the roughening means are helical grooves.

31. An apparatus as claimed in claim 30, wherein the pitch of the helical grooves decreases in the direction of yarn withdrawal from the wedge-like gap.

32. An apparatus as claimed in claim 12, wherein the peripheral speed of the frictional carrying surface is higher than that of the second frictional surface.

* * * * *